US006918199B1

(12) United States Patent
Preta

(10) Patent No.: US 6,918,199 B1
(45) Date of Patent: Jul. 19, 2005

(54) DECORATIVE DEVICE HAVING THE APPEARANCE OF A WINDOW AND DISPLAYING AN EXTERNAL SCENERY

(76) Inventor: Arsenio V. Preta, 174 Meadow St., Naugatuck, CT (US) 06770

( * ) Notice: Subject to any disclaimer, the term of this patent is extended or adjusted under 35 U.S.C. 154(b) by 0 days.

(21) Appl. No.: 10/385,670

(22) Filed: Mar. 12, 2003

(51) Int. Cl.[7] ..... G09F 19/12
(52) U.S. Cl. ..... 40/427; 40/538
(58) Field of Search ..... 40/427, 538, 606.03, 40/611.06, 743; 52/27, 38; 472/57, 137, 472/311.1, 311.3; D6/303

(56) References Cited

U.S. PATENT DOCUMENTS

| | | | | | |
|---|---|---|---|---|---|
| 288,294 | A | | 11/1883 | Baldwin | |
| 1,546,089 | A | * | 7/1925 | Leachman et al. | 40/564 |
| 1,607,922 | A | * | 11/1926 | Schweitzer | 362/125 |
| 1,648,020 | A | | 11/1927 | Labram | |
| 1,721,615 | A | | 7/1929 | Cook | |
| 1,809,378 | A | | 6/1931 | Eschenbach | |
| 1,900,987 | A | | 2/1933 | Goff | |
| 2,019,098 | A | | 9/1935 | Schrickel | |
| 2,654,827 | A | * | 10/1953 | Pierce | 362/147 |
| 2,814,895 | A | * | 12/1957 | Flam | 40/538 |
| 3,447,274 | A | | 6/1969 | Davidson | |
| 3,886,677 | A | | 6/1975 | Behring et al. | |
| 4,177,305 | A | | 12/1979 | Feingold et al. | |
| 4,225,369 | A | | 9/1980 | Felchlin | |
| D272,791 | S | * | 2/1984 | Brobakken | D6/301 |
| 4,584,218 | A | | 4/1986 | Travis | |
| D303,180 | S | * | 9/1989 | Cheng | D6/303 |
| 4,900,604 | A | | 2/1990 | Martinez et al. | |
| 5,075,141 | A | | 12/1991 | Sudmann | |
| 5,118,318 | A | | 6/1992 | Lorizio | |
| 5,196,246 | A | | 3/1993 | Kauss | |
| 5,197,213 | A | | 3/1993 | Borden | |
| 5,251,392 | A | * | 10/1993 | McManigal | 40/427 |
| 5,265,360 | A | * | 11/1993 | Reiss et al. | 40/427 |
| 5,426,879 | A | | 6/1995 | Hecker | |
| 5,887,369 | A | * | 3/1999 | Danielczak | 40/428 |
| 6,266,069 | B1 | | 7/2001 | Thagard et al. | |
| 6,298,592 | B1 | * | 10/2001 | Baier | 40/611.07 |
| 6,536,146 | B2 | * | 3/2003 | Ericson | 40/453 |

* cited by examiner

*Primary Examiner*—Brian K. Green

(57) ABSTRACT

Decorative device which can be mounted to a wall. The device includes a trim portion that resembles a window, a door or a portal. The trim portion includes a front surface and thickness. The trim portion defines an enclosed area that is sized to contain a scene. At least one window or door includes angled surfaces. The at least one window or door includes a front surface, a thickness, and a width that is arranged generally parallel to the front surface of the trim portion. The at least one window or door has the appearance of being opened while being arranged generally parallel to the front surface of the trim portion.

7 Claims, 6 Drawing Sheets

DECORATIVE DEVICE HAVING THE APPEARANCE OF A WINDOW AND DISPLAYING AN EXTERNAL SCENERY

BACKGROUND OF THE INVENTION

1. Field of the Invention

The invention relates to decorative device which has the appearance of a real window and which displays a scenery that has the appearance of a scene which is external to the room from which the decorative device is arranged. The decorative device has the three-dimensional portion which resembles a window trim and a picture or drawing portion which illustrates the external scene. The decorative device can be mounted or hung on a wall to give the wall the appearance that it has a real window.

In one embodiment, the decorative device uses portions of a real window trim, i.e., wood or plastic window trim molding is fastened or otherwise attached together, and a picture or poster containing a scene is placed within or behind the window trim. The window trim can be made to an actual size of a conventional window or can be scaled down by a scale factor, e.g., ¼, ½, ¾, etc. Preferably, the window trim is not made so small that an observer can easily conclude, at a first look, that it is not a true window. It is also preferred that the window trim include at least one window portion and that this window portion have the appearance of being open towards the scenery. This can be accomplished by forming the window portion with angled edges and/or surfaces which fools the eye of the observer into thinking that the window is open towards the outside of the room in which the window trim is installed.

2. Discussion of Background Information

Placing external scenery within a frame is certainly conventional. It is also known, for example, from U.S. Pat. No. 2,019,098 to arrange a three-dimension looking picture with a frame. It is further known, from U.S. Pat. No. 5,426,879, to simulate a window using a three-dimensional frame. Finally, it is known from U.S. Pat. No. 3,447,274, to create elaborate scenery systems.

However, none of these devices are directed to a decorative device that combines a real or generally accurate looking window trim, i.e., that resembles a true window trim molding arrangement in combination with a picture or poster containing a scene being placed within or behind the window trim and further including at least one three-dimensional window portion that has the appearance of being open towards the scenery.

SUMMARY OF THE INVENTION

The invention therefore provides for a decorative device that combines a real or generally accurate looking window trim, i.e., that resemble a true window trim molding arrangement, in combination with a picture or poster containing a scene (which can be placed within or behind the window trim) and including at least one three-dimensional window portion that has the appearance of being open towards the scenery.

According to one embodiment, the window portion can be formed with angled edges which fools the eye of the observer into thinking that the window is open towards the outside of the room in which the window trim is installed. The entire decorative device (not including the picture) can be formed as a one piece metal stamping wherein the window trim is formed or shaped to have a three-dimensional arrangement allowing the scene to be set back from an outer surface of the window trim. The picture or poster can be formed separately and thereafter attached or otherwise secured to the window trim. Finally, the window can be formed separately as a metal stamping and thereafter attached or otherwise secured to the window trim or to the picture, or both.

According to another embodiment, the decorative device (not including the picture) can be formed as one piece from a plastic sheet that is shaped (by e.g., vacuum molding) such that the window trim is formed or shaped to have a three-dimensional arrangement thereby allowing the scene to be set back from an outer surface of the window trim. The picture or poster can be formed separately and thereafter attached or otherwise secured to the window trim. Finally, the window can be formed separately in a manner similar to the window trim and thereafter attached or otherwise secured to the window trim or to the picture, or both.

According to another embodiment, the decorative device (not including the picture) can be formed from a one piece plastic sheet that is shaped (by e.g., vacuum molding) such that the window trim is formed or shaped to have a three-dimensional arrangement with the scene being set back from an outer surface of the window trim. The window can be formed with the window trim at the time the window trim is formed. The picture or poster can be painted or printed on the window trim.

According to still another embodiment, the decorative device (not including the picture) can be formed from wood or plastic pieces that are individually shaped and/or cut. These are then assembled together by fastening or gluing (or both) such that the window trim is formed to have a three-dimensional arrangement. A scene can then be attached to the window trim, e.g., set back from an outer surface of the window trim. The picture or poster can thus be formed separately and thereafter attached or otherwise secured to the window trim. Finally, the window can be formed separately in the same way as the window trim and thereafter attached or otherwise secured to the window trim or to the picture, or both.

According to still another embodiment, the decorative device (not including the picture) can be formed from light-weight material pieces such as light-weight wood or foam that are individually shaped and/or cut. These are then assembled together by fastening or gluing (or both) such that the window trim is formed to have a three-dimensional arrangement. A scene can then be attached to the window trim, e.g., preferably set back from an outer surface of the window trim. The picture or poster with the scene can be formed separately and thereafter attached or otherwise secured to the window trim. Finally, the window, which can be formed separately and/or in the same way as the window trim, is attached or otherwise secured to the window trim or to the picture, or both.

According to still another embodiment, the decorative device, i.e., the window trim and window portion (not including the picture) can be formed from light-weight material such as light-weight wood or foam as one-piece. This would eliminate the need to assemble individual pieces together. Thus, the window trim can be formed to have a three-dimensional arrangement as one piece. A scene can then be attached to the window trim, e.g., set back from an outer surface of the window trim. The picture or poster can thus be formed separately and thereafter attached or otherwise secured to the window trim.

According to still another embodiment, the decorative device (not including the picture) can be formed from any desired sheet material (e.g., a light-weight material) as one-piece. This would eliminate the need to assemble individual pieces together. Thus, the window trim is formed to have a three-dimensional arrangement as one piece. A scene can then be attached to the window trim, e.g., set back from an outer surface of the window trim. The picture or poster can thus be formed separately and thereafter attached or otherwise secured to the window trim. Finally, the window can be formed separately of the same material as that of the window trim and thereafter attached or otherwise secured to the window trim or to the picture, or both. In any of the disclosed embodiments, the window may have the ability to move and may also include real or real looking hardware (e.g., hinges and/or handle(s).

According to still another embodiment, the decorative device (not including the picture) can be formed from light-weight material such as sheet metal. This would eliminate the need to assemble individual pieces together. The window can also be formed integrally with the window trim (i.e, the window trim and window can be formed as one-piece). This would eliminate the need to attached or otherwise secured to the window to the window trim or to the picture. Thus, the window trim and window would be formed to have a three-dimensional arrangement as one piece. A scene can then be attached to the window trim and/or the window from behind. In this way, the picture would be set back from an outer surface of the window trim and the window. The window may also include real or real looking hardware (e.g., hinges and/or handle(s).

Of course, the invention contemplates that features of each of the above-noted embodiments can be used on any of the other embodiments. For example, the hardware (real or real-looking, e.g., plastic or painted on hardware) can be used on any embodiment described herein. Moreover, the particular color or colors of the window trim, the window and the picture, drawing or poster can be formed simultaneously with the forming of the particular device which is to have the coloring. For example, in forming a window trim/window device as a one-piece foam or plastic device, current manufacturing techniques allow the device to be made from a colored material (such as plastic)—thus eliminating the need to use a secondary step of painting the device. This allows the device to be made in a cost effective manner. Moreover, the invention also contemplates making the window trim/window devices and the posters, drawings or pictures, separately so as to allow the user to mix and match a particular window trim/window device with a particular poster, drawing or picture. The user may even want to create or purchase his or her own scenery and place it in a window trim/window device. Thus, the invention contemplates that the scenery can be made removable, replaceable, or otherwise interchangeable.

The invention also contemplates a decorative device which can be mounted to a wall, comprising a trim portion that resembles a window, a door or a portal. The trim portion can comprise a front surface and thickness. The trim portion can define an enclosed area that is sized to contain a scene. At least one window or door can comprise angled surfaces. The at least one window or door can comprise a front surface, a thickness, and a width that is arranged generally parallel to the front surface of the trim portion. The at least one window or door can have the appearance of being opened while being arranged generally parallel to the front surface of the trim portion.

The device may further may comprise a scene in the form of a drawing, a picture, or a poster. The scene may be set back from the front surface by a distance. The scene may have a three-dimensional texture. The scene may be at least one of removable and replaceable. The scene may be removably mounted to the trim portion. The scene may comprise a backing and a poster and the backing may be removably mounted to the trim portion. The device may further comprise a backing arranged in the enclosed area, and the scene may be removably mounted to the backing. The trim portion may comprise a one-piece structure. The trim portion may comprise a plurality of members which are assembled together. The trim portion and the at least one window or door may comprise a one-piece structure. The device may further comprising one of a piece of hardware coupled to the at least one window or door, an image that has the appearance of a piece of hardware coupled to the window or door, and a three-dimensional device that has the appearance of a piece of hardware coupled to the at least one window or door. The at least one window or door may comprise a members that define window or door panes.

The invention also provides for a decorative device which can be mounted to a wall, comprising a trim portion that resembles a window, a door or a portal, the trim portion comprising a front surface and thickness in the range of between ½" and 2", the trim portion defining an enclosed area, a scene being disposed in the enclosed area and set back from the front surface of the trim portion, at least one window or door comprising angled surfaces, and the at least one window or door comprising a front surface that is arranged in front of the scene, a thickness that is generally equal to or less than the thickness of the trim portion, and a width that is arranged generally parallel to the front surface of the trim portion, wherein the at least one window or door has the appearance of being opened while being arranged generally parallel to the front surface of the trim portion.

The device can include at least one of the scene being in the form of a drawing, a picture, or a poster and the scene being at least one of removable and replaceable. The trim portion may comprise a plurality of members which are assembled together. The trim portion and the at least one window or door may comprise a one-piece structure.

The invention also provides for a decorative device which can be mounted to a wall, comprising a trim portion that resembles a window, a door or a portal, the trim portion comprising a front surface and thickness, the trim portion defining an enclosed area, a scene being disposed in the enclosed area and set back from the front surface of the trim portion, at least one window or door comprising upper and lower angled surfaces which taper towards one another and members that define a plurality of differently shaped pane openings, and the at least one window or door comprising a thickness and being arranged in front of the scene, wherein the at least one window or door has the appearance of being opened while being arranged generally parallel to the front surface of the trim portion.

The device may also include at least one of the scene being in the form of a drawing, a picture, or a poster and the scene being at least one of removable and replaceable. The trim portion may comprise a plurality of members which are assembled together.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

Figure 1:
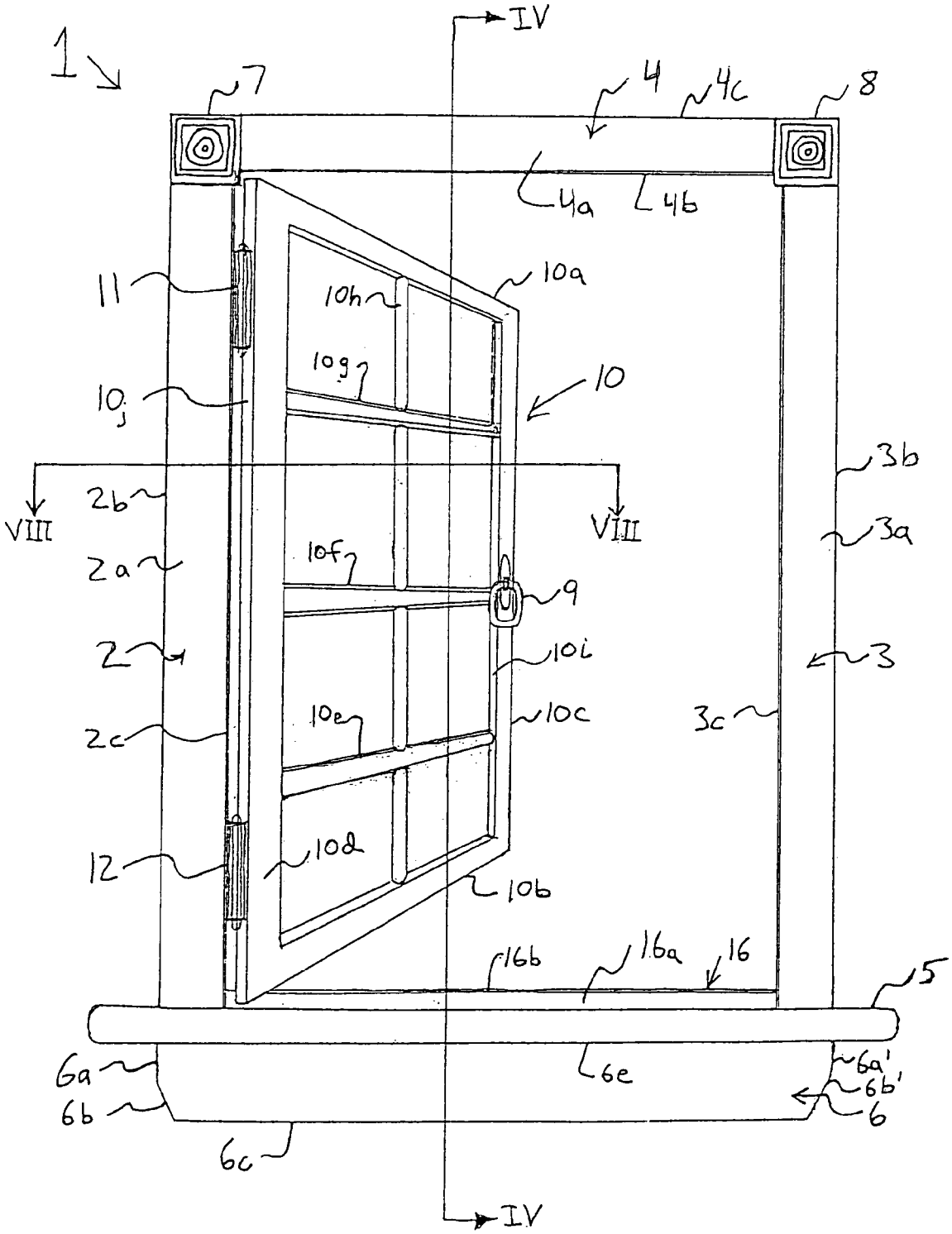
FIG. 1 shows a front view of the decorative window trim/window device. This embodiment uses one window that is arranged on the left side of the window trim. Real hardware is used to lend even more credibility to the window. However, the background scenery is not shown.
Figure 2:
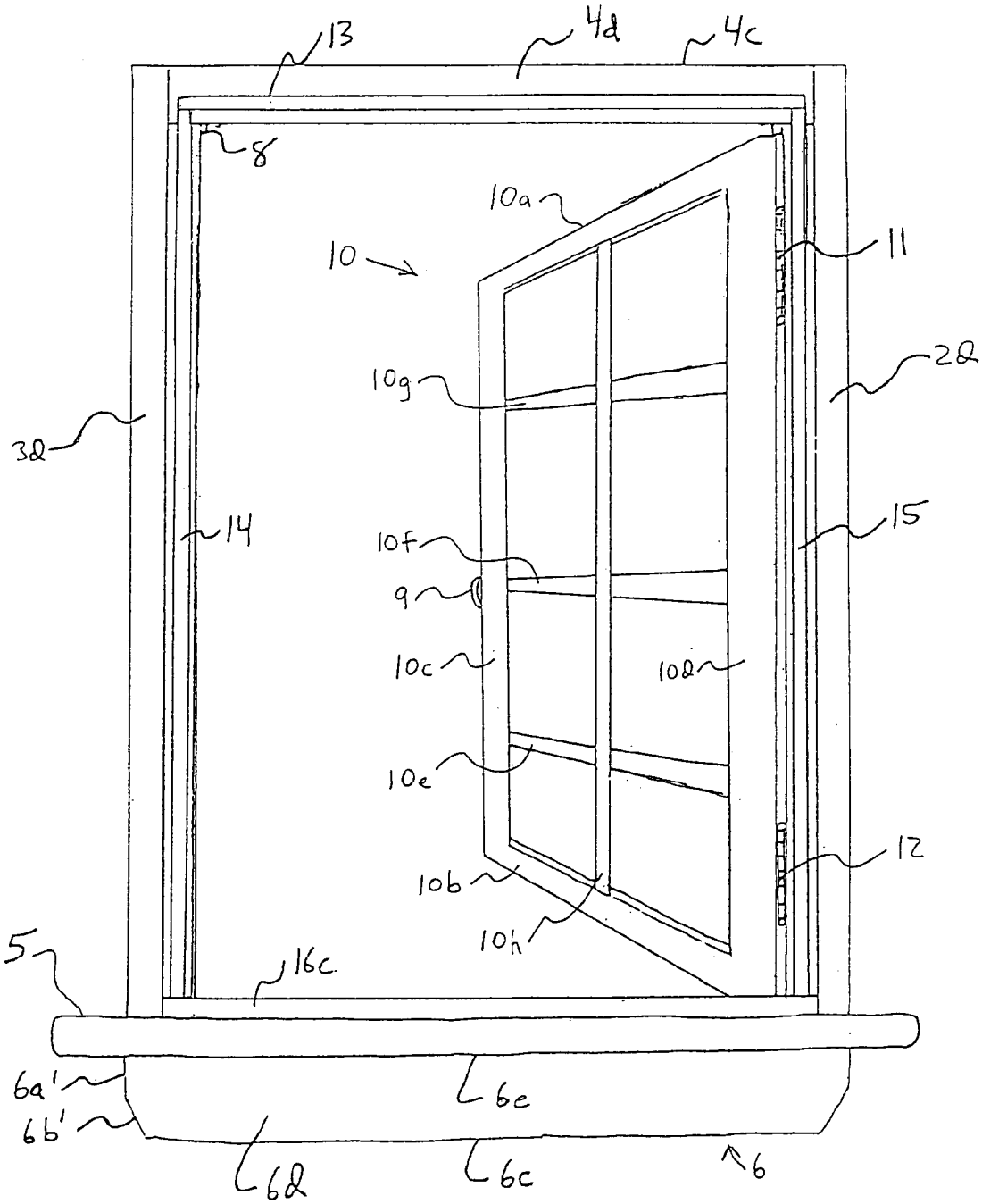
FIG. 2 shows a rear view of the embodiment shown in FIG. 1.
Figure 3:
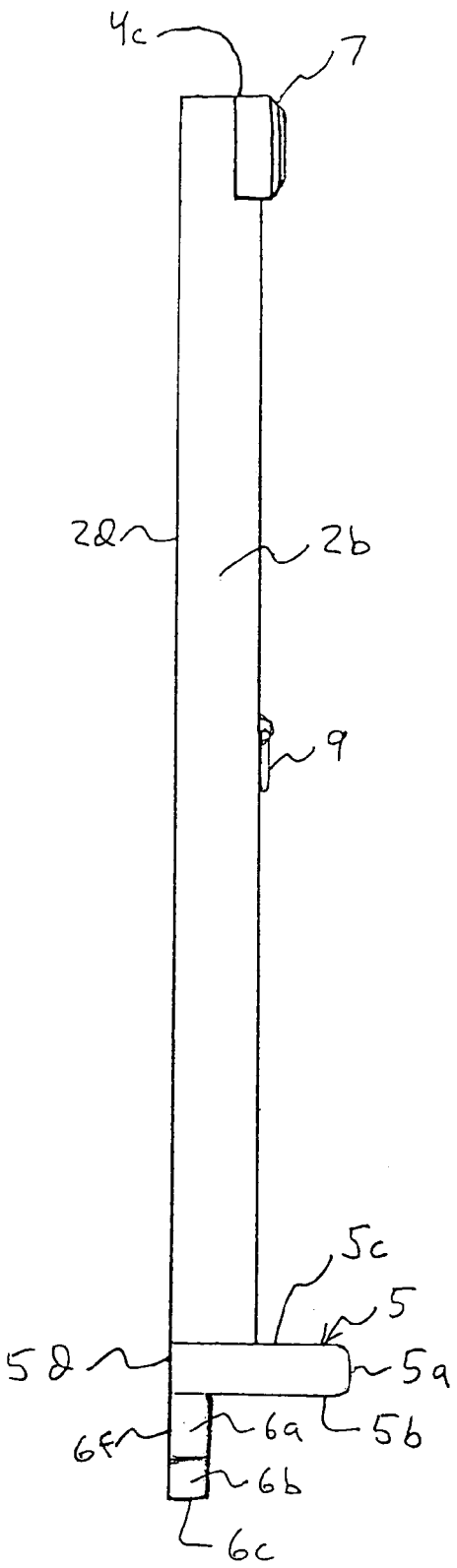
FIG. 3 shows a left side view of the embodiment shown in FIG. 1. The three-dimension appearance of the window trim is evident and a portion of the window hardware (i.e, the handle) is also visible.
Figure 4:
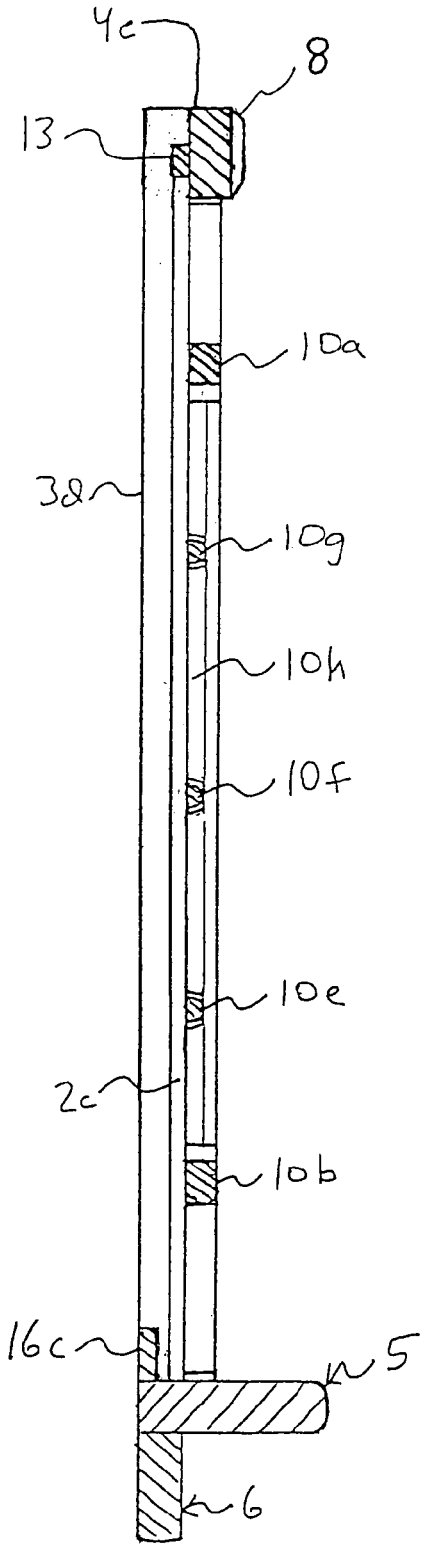
FIG. 4 shows a cross-section view of FIG. 3.
Figure 5:
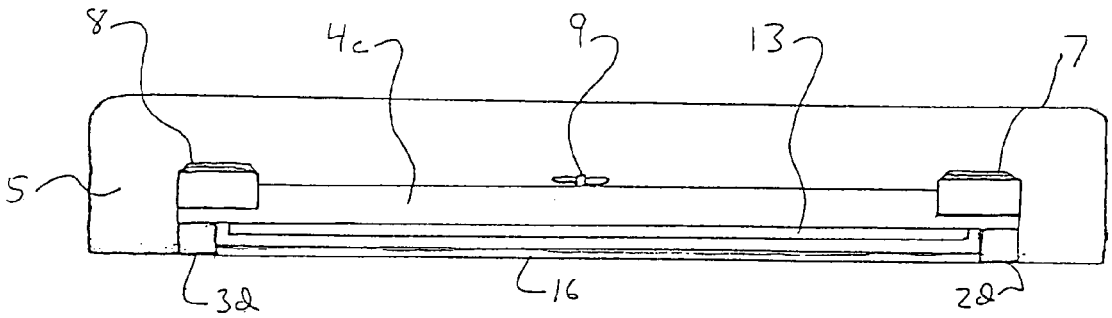
FIG. 5 shows a top view of one embodiment shown in FIG. 1.
Figure 6:
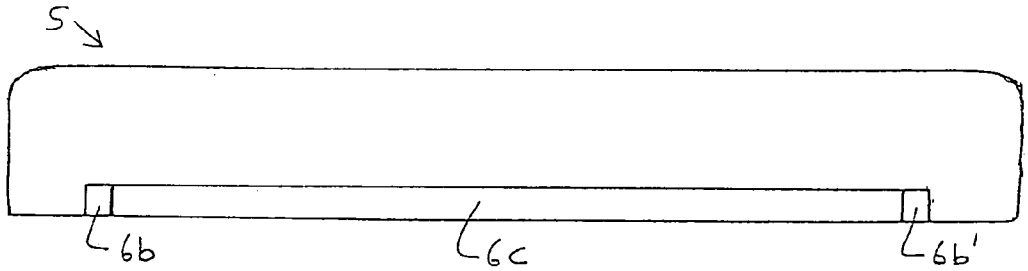
FIG. 6 shows a bottom view of the embodiment shown in FIG. 1.
Figure 7:
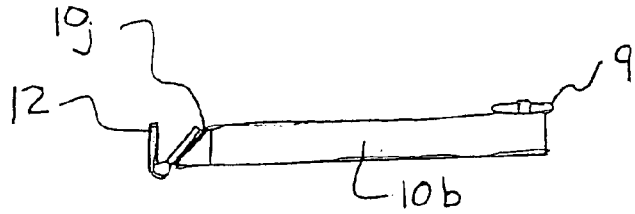
FIG. 7 shows a bottom view of the window used in the embodiment shown in FIG. 1. The real hardware (i.e., hinges and handle) is shown attached to the window.
Figure 8:
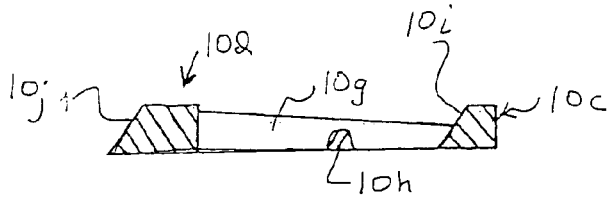
FIG. 8 shows a cross-section view of the window shown in FIG. 7.
Figure 9:
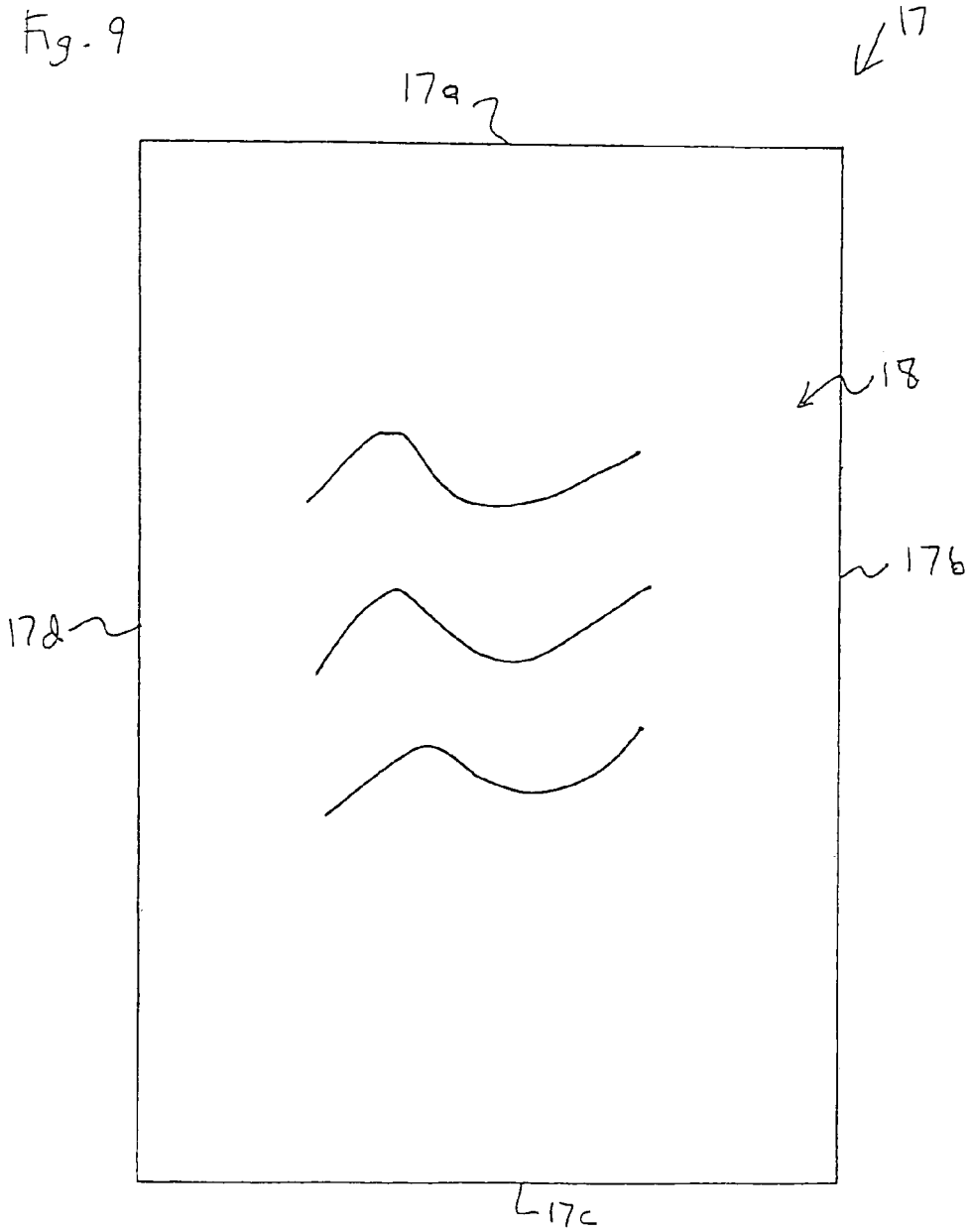
FIG. 9 shows an outline of the poster, drawing or picture which can be used on the embodiment shown in FIG. 1. No particular scene is shown because the invention contemplates that it can be any desired scene such as an outdoor scene. In this embodiment, the scene can be attached to thin piece sheet backing (which can be foam, plastic, or cardboard) so as to provide a good base for the scene and to facilitate its attachment to the window trim.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice. Moreover, the various embodiments are shown having relative scale (i.e., enabling one to compare relative sizes of the various features) for the purpose of illustrating various preferred embodiments. However, the invention contemplates numerous variations in sizes as well as relative sizes of the various features.

FIGS. 1–9 show a decorative window device that includes a window trim 1 and a window 10. The trim 1 includes an upper horizontal member 4 connecting a left side vertical member 2 to a right side vertical member 3. Vertical member 2 has a front surface 2*a*, a left edge 2*b*, a right edge 2*c* and a back surface 2*d*. Vertical member 3 has a front surface 3*a*, a left edge 3*c*, a right edge 3*b*, and a back surface 3*d*. Horizontal member 4 has a front surface 4*a*, a top edge 4*c*, a bottom edge 4*b*, and a back surface 4*d*. The two decorative corner members 7 and 8 are also arranged on the window trim 1. In this embodiment, members 7 and 8 are mounted in a recessed manner in the corners where members 2 and 4 and members 3 and 4 meet. Of course, the members 7 and 8 can also serve to connect members 2 and 4 and 3 and 4 together as is conventionally done with real windows.

The left side decorative member 7 is square shaped and has a protruding surface that is formed with a three-dimensional decoration. The right side decorative member 8 is also square shaped and has a protruding surface that is formed with a three-dimensional decoration. Of course, these decorations need not be three-dimensional and can instead be a two-dimensional picture of a decoration, i.e., a picture of a three-dimensional decoration.

The trim 1 also includes a lower horizontal member 5 which connects the left side vertical member 2 to the right side vertical member 3. This member 5 projects outwards more so than the surfaces 2*a*, 3*a*, and 4*a* of the other trim members 2, 3, 4. Trim member 5 has a front surface 5*a*, a top edge 5*c* that is coupled to bottom ends of members 2 and 3, a bottom edge 5*b* that is coupled to a top edge 6*e* of member 6, and a back surface 5*d* that is made flush with the back surfaces 2*d*, 3*d* and 6*f*. Trim member 6 is arranged below member 5 and has a left edge 6*a*, an angled portion 6*b*, a front surface 6*d*, a top edge 6*e* that is coupled to bottom surface 5*b* of member 5, a bottom edge 6*c*. Trim member 6 also has a right edge 6*a*' and an angled portion 6*b*'.

The trim 1 further includes a lower horizontal retaining member 16 which is coupled to the left side vertical member 2 and the right side vertical member 3. Retaining member 16 has a front surface 16*a*, a top edge 16*b*, a bottom edge that is coupled to a top edge 5*c* of member 5, and a back surface 16*c* that is made flush with the back surfaces 2*d*, 3*d*, 5*d* and 6*f*. Member 16 serves as a lip to help retain the bottom edge 17*c* of the picture backing 17 (which can be a sheet of cardboard or the like). A spacing or gap is thus provided between surface 16*a* and back surfaces of members 14 and 15 (see FIG. 4).

The trim 1 further includes a picture receiving recess that is formed by members 13–15. Member 13 is an upper horizontal member that is coupled to the back surface 4*d* of member 4. Member 14 is a vertical member that is coupled to the back surface 3*d* of member 3 and member 15 is a vertical member that is coupled to the back surface 2*d* of member 2. The upper surface 5*c* of member 5 serves as the fourth part of a rectangular shaped opening that is sized to receive backing 17 (with some clearance of course). To install the picture 18 and backing 17 in this embodiment, (i.e., from the back side shown in FIG. 2) one needs only to slide 17*c* between member 16 and members 14 and 15. Then, the picture 18 and backing 17 can be pivoted towards the trim until edges 17*a*, 17*b* and 17*d* are arranged within members 13–15. To help ensure that the picture 18/backing 17 are retained properly, a bead of adhesive or caulking can be placed between edges 17*a*, 17*b*, and 17*d* and the inside surfaces of members 13–15.

The window 10 is preferably formed of the same material as the trim members 2–8 and 13–16, but can be made of any desired material including a material that is different from that of the members 2–8 and 13–16. The window 10 includes upper angled member 10*a* which can be angled (relative to, e.g., surface 4*b*) between approximately 10 degrees and approximately 45 degrees or more. The greater the angle, of course, the greater the window 10 has the appearance of being opened. That is, an angle of 45 degrees gives the window 10 an appearance that the window 10 is opened outwards to a greater extend than an angle of 10 degrees. It should be noted, however, that an angle approaching 30 to 40 degrees is ideal since it has proven to have the greatest effect on the perception of an observer, i.e., angles less than 20, or even 30, degrees may appear less realistic, and the observer will be more likely to think that the window is fake or false.

The window 10 also includes lower angled member 10*b* which can similarly be angled (relative to, e.g., surface 5*c*) between approximately 10 degrees and approximately 45 degrees or more. Again, the greater the angle, of course, the greater the window 10 has the appearance of being opened. That is, an angle of 45 degrees gives the window 10 an appearance that the window 10 is opened outwards to a greater extend than an angle of 10 degrees. Preferably, the angle of the member 10*a* is substantially equal to the angle of member 10*b*. However, the invention contemplates that these angles may be different for different effect on the user. For example, if the decorative device is to be positioned at eye level, these angles can be the same or very close to the same. However, if the device is to be mounted on an angled wall or above or below eye level, these angles can be made different. Thus, for example, if the device is to be arranged above eye level, it may be desirable to make the angle of member 10*b* less or more than the angle of member 10*a*, depending the particular effect desired, e.g., whether the window 10 will have the appearance of being more or less opened.

The window additionally includes left vertical member 10*d*. This member 10*d* is arranged near member 2. To complete the effect, hinges 11 and 12 (whether real or simulated) are used between the member 10*d* and member 2. To ensure that the effect is complete, member 10*d* also has an angled surface 10*j* to which the hinges 11, 12 are coupled (see FIG. 7). The other portion of hinges 11 and 12 will, of course, be attached to the member 2 and specifically surface 2*c* of member 2. Even greater effect is ensured if screws (whether real or simulated) are visible on the hinges 11 and 12. The angle of surface 10*j* (relative to, e.g, surface 2*c*) is preferably between approximately 10 degrees and approximately 45 degrees or more. Again, the greater the angle, of course, the greater the window 10 has the appearance of being opened. That is, an angle of 45 degrees gives the window 10 an appearance that the window 10 is opened outwards to a greater extend than an angle of 10 degrees. It should be noted, however, that an angle approaching 30 to 40 degrees is ideal since it has proven to have the greatest effect of the perception of an observer, i.e., angles less than 20, or even 30, degrees may appear less realistic, and the observer will be more likely to think that the window is fake or false.

The window additionally includes right vertical member 10*c*. This member 10*c* is arranged near a center of the device and is preferably positioned between member 2 and the center of the device. To complete the effect, a handle 9 (whether real or simulated) is arranged on the member 10*c*. To further ensure that the effect is complete, screws (whether real or simulated) should be visible on the handle 9 providing the reality or illusion that screws connect the handle 9 to the member 10*c*. Member 10*c* also has an angled surface 10*i* (see FIG. 8). The angle of surface 10*i* (relative to, e.g, surface 2*c*) is preferably between approximately 10 degrees and approximately 45 degrees or more. This surface should correspond somewhat to the angle of surface 10*j*. However, the desired effect can be even greater if the angle of surface 10*i* is less than the angle used for surface 10*j*. This relationship can be generally expressed as a desired ratio, with angle of surface 10*i* being between ⅓ and ½ of the angle of surface 10*j*. Of course, the invention contemplates that any desired ratio can be used and any desired angle can be used for surfaces 10*j* and 10*i*—provided that such angle combinations result in a more desirable realistic appearance. As with the angle of surface 10*j*, this angle (relative to, e.g, surface 2*a*) is preferably between approximately 10 degrees and approximately 45 degrees or more. Again, the greater the angle, of course, the greater the window 10 has the appearance of being opened. That is, an angle of 45 degrees gives the window an appearance that the window is opened outwards to a greater extend than an angle of 10 degrees. It should be noted, however, that an angle approaching 30 to 40 degrees is ideal since it has proven to have the greatest effect of the perception of an observer, i.e., angles less than 20, or even 30, degrees appear less realistic, and the observer will be more likely to think that the window is fake or false.

The window also includes window pane members 10*e*–10*h*. Members 10*e*, 10*f* and 10*g* are angled slightly relative to the horizontal. Thus, member 10*e* is angle slightly upwards and is preferably between approximately 5 degrees and approximately 25 degrees or more relative to surface 5*c*. Again, the greater the angle, of course, the greater the window 10 has the appearance of being opened. Member 10*f* can be angle less than member 10*e* and is preferably oriented generally horizontal. Again, the angle will be based on the other angles of the window 10 so that the window 10 has the appearance of being proportional and opened. Member 10*g* is angle slightly downwards and is preferably between approximately 5 degrees and approximately 25 degrees or more relative to surface 4*b*. Again, the greater the angle, of course, the greater the window 10 has the appearance of being opened. This angle is also preferably made similar (mirror image of) to the angle of member 10*e* when the window 10 is to be positioned at eye level. Finally, member 10*h* can be oriented generally vertically or parallel to members 10*d* and 10*c*. The position of member 10*h* (relative to members 10*c* and 10*d*) can be one where it is centrally located. However, there appears to be a greater effect if the member 10*h* is positioned slightly closer to member 10*c* than member 10*d*.

The window pane members 10*e*–10*g* can be made as symmetrical members. However, it is preferred that they be slightly tapered (see FIG. 8). Thus, the ends that connect to member 10*d* are wider and/or thicker (thickness being measured in a direction that is perpendicular to, e.g., surface 2*a*) than the ends that connect to member 10*c*. Similarly, members 10*a* and 10*b* have ends (that connect to member 10*d*) which are wider (though they need not be made thicker) than the ends that connect to member 10*c*. Good results have been obtained if the ends of members 10*e*–10*g* that connect to member 10*c* are approximately ½ the width and thickness of the ends that connect to member 10*d*. The ends of members 10*a* and 10*b* that connect to member 10*c* are similarly approximately ½ the width of the ends that connect to member 10*d*. The thickness of members 10*a* and 10*b* can be held constant from the ends that connect to member 10*d* to the ends that connect to member 10*c* if desired. Alternatively, the thickness can also taper slightly towards the ends that connect to member 10*c*.

Members 10*e*–10*h* are also preferably formed with rounded front edges, i.e., formed with rounded corners. The ends of members 10*e*–10*g* that connect to member 10*c* can even be formed with a front convex or curved surface. On the other hand, the ends of members 10*e*–10*g* that connect to member 10*d* can even be formed with a flat front surface that has rounded corners. However, viewed from the back (see FIG. 2) members 10*a*–10*h* can have generally flat rear surfaces and these surfaces can all be arranged on a common or same plane. Members 10*a*–10*d* are also preferably formed with flat surfaces having rounded front edges, i.e., formed with rounded corners.

In this embodiment, members 2–8 are formed individually from a material such as wood, plastic, or foam. They can then be assembled by gluing and/or fastening using an adhesive and/or nails or screws. Alternatively, the trim 1 can be formed as one-piece, i.e., members 2–8 are made as one-piece from a material such as wood, plastic, or foam. If wood the used as the material, the members 2–8 can be made individually using by cutting and otherwise shaping the individual pieces using conventional wood-working techniques. Preferably, the wood used is a light-weight wood such as pine, balsa, or even cork which can be painted or stained. The trim 1 can also be formed from compressed paper or cardboard material (e.g., recycled materials). If plastic or foam is used as the material, the members 2–8 can be made either individually by, e.g., by cutting and otherwise shaping the individual pieces using conventional shaping or molding techniques. The trim 1 can also be form as a single piece from any desired material described herein. The members 2–8 (as a one-piece structure) can even be formed from a plastic sheet, e.g., of a thickness of between 1/64" and 1/8" or more, that is vacuum formed or shaped to have a three-dimensional arrangement. This provides for a trim 1 that is very light since it is essentially a hollow structure.

The window 10 can also be formed in the above-noted manner(s), i.e., from individual members 10*a*–10*h*. Alternatively, it can be formed as a one-piece structure either separately or with the trim 1. Thus, it can also be made from a plastic sheet, e.g., of a thickness of between 1/64" and 1/8" or more, that is vacuum formed or shaped to have a three-dimensional arrangement. It is most preferable if the entire device, i.e., members 2–8, the window 10, and optionally, even the hinges 11 and/or the handle 9, is formed as one-piece structure from a plastic sheet, e.g., of a thickness of between 1/64" and 1/8" or more, that is vacuum formed or shaped to have a three-dimensional arrangement. shown in FIGS. 1–6. It is even possible to place a thin plastic transparent sheet can be placed behind the window 10 to give the appearance that window 10 has glass panes.

If the entire device is formed as a one-piece structure, the members 13–17 can possibly be dispensed with. These would be replaced with a backing that is integrally formed (not shown) with the one-piece trim 1/window 10 structure. This backing would have a three-dimensional structure of the window 10 formed therein and could also have three-dimensional features of the picture formed therein. According to one embodiment, the picture, the trim 1, hinges, handle, and the window 10 are first formed (i.e., by painting, printing, etc.,) on a plastic sheet in a distorted way. Then, when the sheet is shaped or deformed to have the three-dimensional configuration shown in FIGS. 1–6, it will resemble a real looking window through which one appears to see an external scene, such as an out-door scene.

Figure 10:
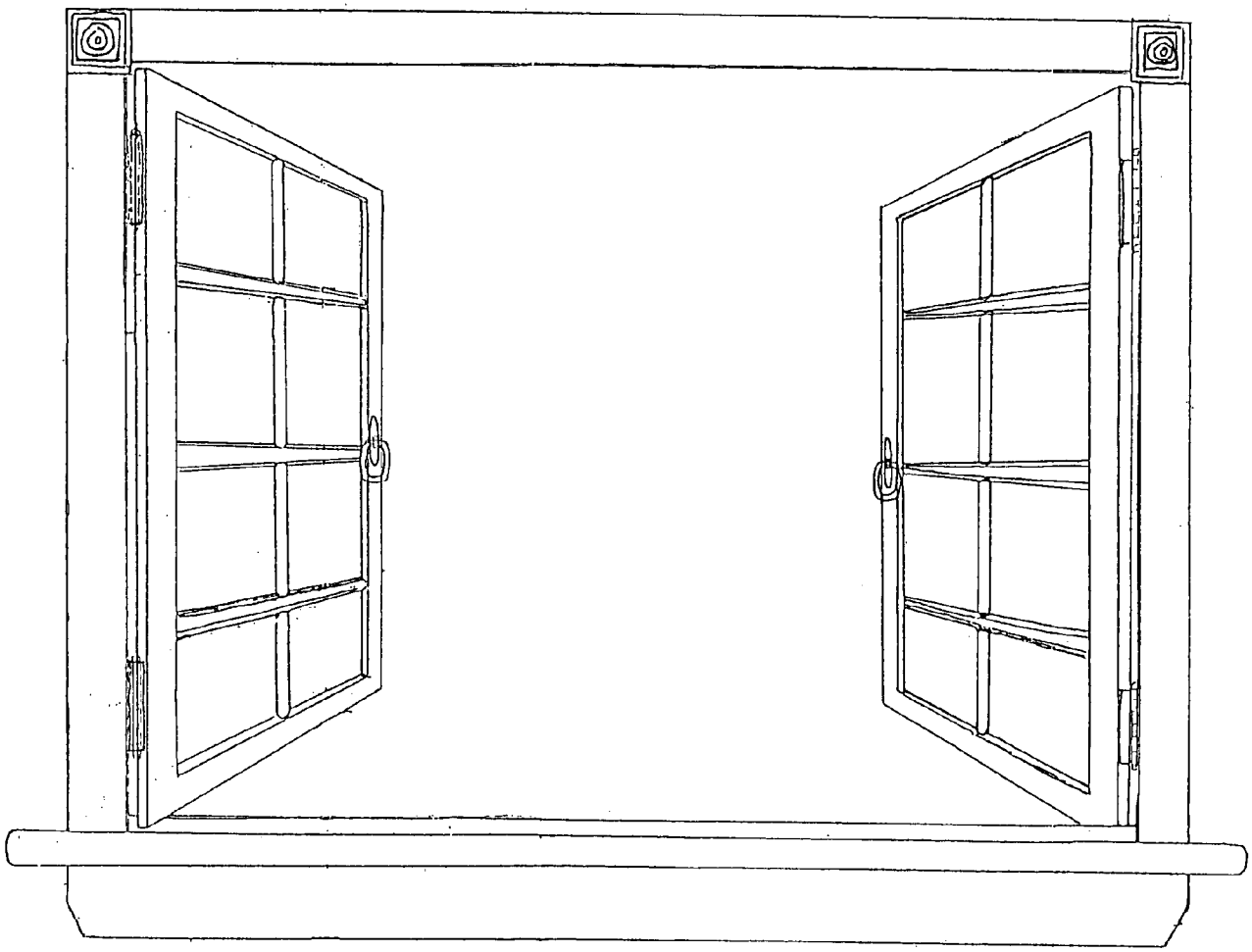
FIG. 10 shows a front view of another embodiment of a decorative device. In this embodiment, two windows are used.

FIG. 10 illustrates that the device can have a configuration that accommodates more than one window. This embodiment uses two windows. Of course, the invention contemplates that the window trim have other shapes such, e.g., as one which resembles a ship window (i.e., circular), and windows that have arch-shaped upper portions. Generally, the invention contemplates that the decorative device can resemble any desired window or door or portal, whether conventional or otherwise provided that it has a three dimensional trim and at least one window or door that is formed to have the appearance of being opened. Thus, the window can be circular, oval, square, rectangular, and/or have edges use surfaces that are curved and straight, as well as combinations thereof.

The invention contemplates various additional features. For example, the window 10 can be made movably mounted to the trim 1. This can have two advantages. First, it lends reality to the decorative device. Second, it can allow one to place a new picture (allow for replacement of the picture) from the front of the decorative device, i.e., the device can be adapted to allow the window 10 to swing outwards up to an angle defined by surface 10*j*. Then, the picture 18 could be easily replaced from the front without the device having to be removed from a wall. To facilitate this, the invention even contemplates mounting hook and loop fastening devices near the four corners of the backing 17. Complementary fastening devices would be arranged in a similar configuration on a non-removable backing (not shown). In this way, the picture can be easily replaced to reflect particular holidays, seasons, moods, geographic locations etc. This would include, e.g., snow covered pine trees illustrating a winter scene, a beach scene in the summer, a patio scene in the fall season, and a garden scene in the spring. Of course, one can hang the device on any type of desired wall and using any desired technique, when conventionally known or otherwise.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A decorative device which can be mounted to a wall, comprising;

a trim portion that resembles a window trim, a door trim or a portal trim;

the trim portion comprising a front surface and thickness in the range of between 1/2" and 2";

the trim portion defining an enclosed area;

a scene being disposed in the enclosed area and set back from the front surface of the trim portion;

at least one window or door comprising a front surface that is arranged in front of the scene, the at least one window or door having a thickness that is generally equal to or less than the thickness of the trim portion, and the front surface of the at least one window or door is arranged generally parallel to the front surface of the trim portion; and the at least one window or door comprising:

upper and lower angled members which taper towards one another from an inside edge of the trim portion and towards an opposite inside edge of the trim portion; and additional angled members in combination with the upper and lower angled members which define a plurality of pane openings, wherein the at least one window or door has the appearance of being opened while being arranged generally parallel to the front surface of the trim portion.

2. The device of claim 1, and at least one of:

the scene being in the form of a drawing, a picture, or a poster; and the scene being at least one of removable and replaceable.

3. The device of claim 1, wherein the trim portion comprises a plurality of members which are assembled together.

4. The device of claim 1, wherein the trim portion and the at least one window or door comprise a one-piece structure.

5. A decorative device which can be mounted to a wall, comprising;

a trim portion that resembles a window trim, a door trim or a portal trim;

the trim portion comprising a front surface and thickness in the range of between ½" and 2";

the trim portion defining an enclosed area;

a scene being disposed in the enclosed area and set back from the front surface of the trim portion;

at least one window or door comprising upper and lower angled members which taper towards one another and additional members in combination with the upper and lower angled members that define a plurality differently shaped pane openings; and the at least one window or door comprising a thickness and being arranged in front of the scene, wherein the at least one window or door has the appearance of being opened while being arranged generally parallel to the front surface of the trim portion.

6. The device of claim 5, and at least one of:

the scene being in the form of a drawing, a picture, or a poster; and the scene being at least one of removable and replaceable.

7. The device of claim 5, wherein the trim portion comprises a plurality of members which are assembled together.

* * * * *